US006959784B2

(12) United States Patent
Diggle et al.

(10) Patent No.: US 6,959,784 B2
(45) Date of Patent: Nov. 1, 2005

(54) TORSO HARNESS

(76) Inventors: Frederick J. Diggle, 2054-H Vestavia Park Ct., Birmingham, AL (US) 35216; Knox L. Faulkner, 109 Woodburn Dr., Sterrett, AL (US) 35147

( * ) Notice: Subject to any disclaimer, the term of this patent is extended or adjusted under 35 U.S.C. 154(b) by 32 days.

(21) Appl. No.: 10/643,178

(22) Filed: Aug. 18, 2003

(65) Prior Publication Data

US 2005/0039980 A1 Feb. 24, 2005

(51) Int. Cl.[7] ..... A47L 3/04

(52) U.S. Cl. ..... 182/9; 182/3; 182/18; 280/805; 244/1 R

(58) Field of Search ..... 182/9, 3, 18; 280/805; 244/151 R

(56) References Cited

U.S. PATENT DOCUMENTS

| | | | | | |
|---|---|---|---|---|---|
| 194,471 | A | | 5/1877 | Schultz | |
| 2,267,791 | A | * | 12/1941 | Ernest et al. | 244/142 |
| 2,693,598 | A | * | 11/1954 | Young | 2/16 |
| 2,842,300 | A | | 7/1958 | Johnson | |
| 2,879,830 | A | | 3/1959 | Johnson | |
| 2,920,714 | A | | 1/1960 | Johnson | |
| 3,074,760 | A | * | 1/1963 | Hodgekin | 297/472 |
| 3,209,424 | A | * | 10/1965 | Cadion | 24/196 |
| 3,295,517 | A | * | 1/1967 | Stevens | 602/19 |
| 3,326,432 | A | * | 6/1967 | Banks et al. | 224/258 |
| 3,444,957 | A | * | 5/1969 | Ervin, Jr. | 182/3 |
| 3,762,507 | A | | 10/1973 | Starr | |
| 4,100,996 | A | | 7/1978 | Sharp | |
| 4,253,544 | A | | 3/1981 | Dalmaso | |
| 4,273,215 | A | * | 6/1981 | Leggett | 182/3 |
| 4,407,391 | A | | 10/1983 | Greenway | |
| 4,427,092 | A | | 1/1984 | Tentler | |
| 4,527,660 | A | | 7/1985 | Andruchiw | |
| 4,595,078 | A | | 6/1986 | Greenway | |
| 5,113,981 | A | | 5/1992 | Lantz | |
| 5,229,178 | A | * | 7/1993 | Zemitis | 428/37 |
| 5,257,677 | A | | 11/1993 | Stepp | |
| 5,341,896 | A | * | 8/1994 | Amacker | 166/270 |
| 5,738,046 | A | * | 4/1998 | Williams et al. | 119/770 |
| 6,006,860 | A | * | 12/1999 | Bell | 182/18 |
| 6,016,891 | A | | 1/2000 | Sava | |
| 6,158,548 | A | * | 12/2000 | May | 182/3 |
| 6,206,138 | B1 | | 3/2001 | Yerger | |
| 6,241,045 | B1 | | 6/2001 | Reeve | |
| 6,315,179 | B1 | | 11/2001 | Hillis | |
| 6,390,234 | B1 | | 5/2002 | Boyer | |
| 6,467,573 | B1 | * | 10/2002 | Parker | 182/3 |
| 6,533,066 | B1 | | 3/2003 | O'Dell | |
| 6,691,824 | B2 | * | 2/2004 | Sharp | 182/3 |
| 2002/0020582 | A1 | * | 2/2002 | Boyer | 182/3 |
| 2002/0046903 | A1 | | 4/2002 | Strickler | |
| 2002/0175024 | A1 | | 11/2002 | Kurtgis | |
| 2003/0057018 | A1 | * | 3/2003 | Dodson et al. | 182/3 |
| 2004/0140158 | A1 | * | 7/2004 | Wilcox et al. | 182/187 |
| 2004/0154863 | A1 | * | 8/2004 | Green | 182/7 |

* cited by examiner

*Primary Examiner*—Bruce A. Lev
(74) *Attorney, Agent, or Firm*—Walters & Zimmerman; Jennifer Medlin; Todd Mitchem

(57) ABSTRACT

A torso harness for reducing injury from a fall from a utility pole. The torso harness has a segment of elastic cordage having a first end and a second end. The torso harness also has means for securing the first end to a support device in the utility pole and means for securing the second end to a technician's safety belt. The segment of elastic cordage stretches to decelerate the technician during a fall from the utility pole.

14 Claims, 12 Drawing Sheets

TORSO HARNESS

NOTICE OF COPYRIGHT PROTECTION

A portion of the disclosure of this patent document and its figures contain material subject to copyright protection. The copyright owner has no objection to the facsimile reproduction by anyone of the patent document or the patent disclosure, but the copyright owner otherwise reserves all copyrights whatsoever.

BACKGROUND OF THE INVENTION

1. Field of the Invention

This invention generally relates to fires escapes, ladders, and scaffolding and, more particularly, to torso harnessing.

2. Description of the Related Art

In the telecommunications or electronics industry, it is common practice for a technician (also referred to as a "linesman") to climb a utility pole. The technician climbs the utility pole to install equipment, to repair broken or damaged communications equipment, to test equipment, and/or for other work-related reasons. In order to safely and effectively climb a pole and perform line work, the technician must maintain and properly utilize various types of climbing equipment. To utilize the various types of climbing equipment, the technician must also have the skills and the physical ability to sustain a great strain on their legs and back while the technician climbs and/or maintains a position about the pole.

Conventional climbing equipment employed by a technician typically includes a pair of gaffs, a body belt, and/or a safety strap. In general, the gaff is a sharp blade protruding from the inside of the foot about mid-foot level and having straps that secure about the leg and/or feet of a technician. To climb, the technician drives one of the gaffs into the pole, steps up onto the gaff, and then drives the other gaff into the pole at a higher position. The technician continues taking steps up or "gaffs up" the pole until reaching a desired height.

The body belt is secured around the waist of the technician. The body belt includes pockets for carrying tools and rings (e.g., "D-rings") for attaching the safety strap. The safety strap typically includes a hook (e.g., snap buckle) at each end and a buckle for adjusting its length. During climbing, both hooks of the safety strap are attached to the same ring of the body belt on the left hip. Once in a position to perform line work, the technician releases one end of the safety strap from the body belt. The technician then wraps the safety strap around the pole and reattaches the end of the safety strap to the body belt, thus allowing the technician to use his hands at the desired working elevation. Thus, the technician uses the safety strap for climbing as well as supporting the technician in his working position about the pole.

During elevated line work, both gaffs are pressed into the pole and the technician leans back against the safety strap. This position allows the weight of the technician to be supported by the gaffs and the tension in the safety strap. An error in technique or defect in equipment, however, may result in serious injury to the technician. For example, there are times when a gaff dislodges or "cuts out" from the pole. If one or both of the gaffs cuts out, the technician may (i) fall straight down from atop the pole, (ii) rotate downward and fall on the head, (iii) get one or more gaffs back into the pole, and (iv) may reach out to grab/hug the pole. In many of these scenarios, the technician may, and often does, sustain injury such as to the knees, back, and/or arms.

Safety devices have been proposed for supporting the weight of the technician to prevent accidents as described above; however, the usefulness of such safety devices depends upon the willingness of the technician to use them which in turn relies upon whether such devices are conveniently and easily used in the field. As an alternative to climbing the pole, some technicians resort to using ladders or bucket trucks to perform elevated line work so as to avoid the risk of injury from a fall. This solution requires the purchase and maintenance of additional equipment and, thus, results in increased expenses for the technician's employer. In addition, work related injuries still occur when using and transporting a ladder of the size necessary to reach the top of a pole.

BRIEF SUMMARY OF THE INVENTION

The aforementioned problems, and other problems, are reduced by a torso harness. Should a technician fall from a utility pole, this torso harness helps reduce, and perhaps even prevent, injury to the technician. The torso harness of this invention utilizes elastic cordage to decelerate the technician during a fall. Unlike a taut safety line or rope, this invention will not jolt or jar the technician, and this torso harness can even prevent the technician from striking the earth. The torso harness may even include additional features that help identify the age of the torso harness and its remaining elasticity.

One of the embodiments of this invention describes a torso harness for reducing injury from a fall from a utility pole. The torso harness has a segment of elastic cordage having a first end and a second end. The torso harness also has means for securing the first end to a support device in the utility pole and means for securing the second end to a technician's safety belt. The segment of elastic cordage stretches to decelerate the technician during a fall from the utility pole.

Another of the embodiments of this invention describes a method for reducing injury from a fall from a utility pole. A technician dons a technician's safety belt and ascends a utility pole to a desired height. A torso harness is secured between the technician's safety belt and a support device in the utility pole. The torso harness comprises a segment of elastic cordage having a first end and a second end, means for securing the first end to the support device in the utility pole, and means for securing the second end to the technician's safety belt. The torso harness stretches to decelerate the technician during a fall from the utility pole.

Other systems, methods, and/or computer program products according to embodiments will be or become apparent to one with skill in the art upon review of the following drawings and detailed description. It is intended that all such additional systems, methods, and/or computer program products be included within this description, be within the scope of the present invention, and be protected by the accompanying claims.

BRIEF DESCRIPTION OF THE SEVERAL VIEWS OF THE DRAWINGS

These and other features, aspects, and advantages of this invention are better understood when the following Detailed Description of the Invention is read with reference to the accompanying drawings, wherein.

DETAILED DESCRIPTION OF THE INVENTION

This invention now will be described more fully hereinafter with reference to the accompanying drawings, in which exemplary embodiments are shown. This invention may, however, be embodied in many different forms and should not be construed as limited to the embodiments set forth herein; rather, these embodiments are provided so that this disclosure will be thorough and complete, and will fully convey the scope of the invention to those of ordinary skill in the art. Moreover, all statements herein reciting embodiments of the invention, as well as specific examples thereof, are intended to encompass both structural and functional equivalents thereof. Additionally, it is intended that such equivalents include both currently known equivalents as well as equivalents developed in the future (i.e., any elements developed that perform the same function, regardless of structure).

Thus, for example, it will be appreciated by those of ordinary skill in the art that the diagrams, schematics, flowcharts, and the like represent conceptual views or processes illustrating systems and methods embodying this invention. Those of ordinary skill in the art further understand that the exemplary harnessing, methods, and/or systems described herein are for illustrative purposes and, thus, are not intended to be limited to any particular named manufacturer.

The aforementioned problems, and other problems, are reduced by a torso harness. Should a technician fall from a utility pole, this torso harness helps reduce, and perhaps even prevent, injury to the technician. The torso harness of this invention utilizes elastic cordage to decelerate the technician during a fall. Unlike a taut safety line or rope, this invention will not jolt or jar the technician, and this torso harness can even prevent the technician from striking the earth. The torso harness may even include additional features that help identify the age of the torso harness and it's remaining elasticity.

Figure 1:
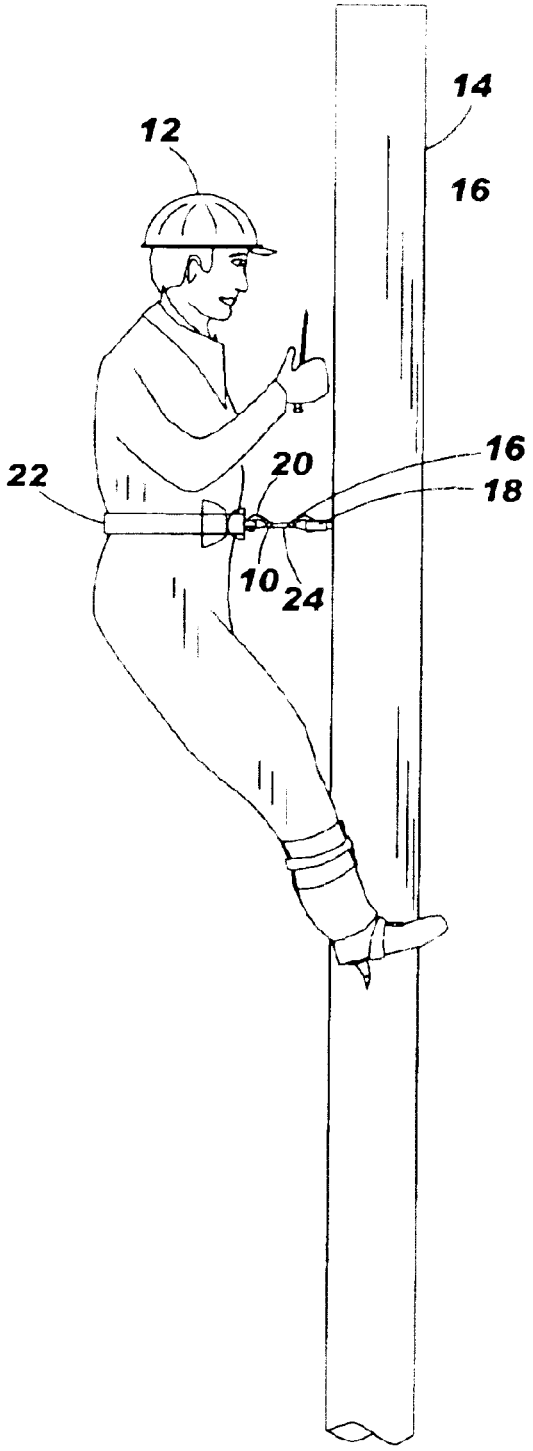
FIGS. 1 and 2 are schematics showing a torso harness according to the embodiments of this invention.
Figure 2:
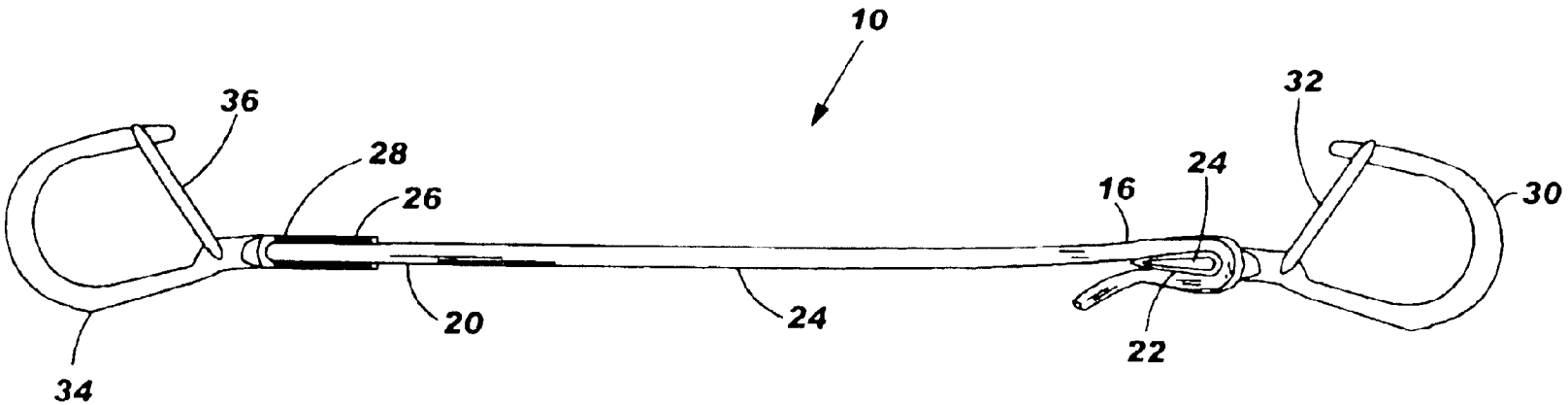

FIGS. 1 and 2 are schematics showing one of the embodiments of a torso harness 10. FIG. 1 is a schematic illustrating the torso harness 10 secured between a technician 12 and a utility pole 14, while FIG. 2 is a schematic illustrating the torso harness 10. Should the technician 12 fall from the utility pole 14, this torso harness 10 helps reduce injury by stretching to decelerate the technician during the fall. As FIG. 1 shows, one end 16 of the torso harness 10 secures to a support device 18 in the utility pole 14. The support device 18 is a spike, hook, eyelet, or other device that is driven into the utility pole 14. The torso harness 10 secures at a second end 20 to a technician's safety belt 22. The technician's safety belt 22 typically secures around the technician's 12 waist and/or torso. The torso harness 10 also comprises a segment 24 of elastic cordage. If the technician 12 falls from the utility pole 14, the segment 24 of elastic cordage stretches to decelerate the technician 12 during the fall and helps to prevent the technician 12 from striking the ground (not shown).

FIG. 2 is a detailed schematic of the torso harness 10. The torso harness 10 includes the segment 24 of elastic cordage having the first end 16 and the second end 20. A first termination 22 clamps the first end 16 about a first eyelet 24. A second termination 26 clamps the second end 20 about a second eyelet 28. The terminations 22 and 26 are preferably used to terminate the segment 24 without resorting to knots. The torso harness 10 also includes means for securing the first end 16 to the support device (shown as reference numeral 18 in FIG. 1) and means for securing the second end 20 to the technician's safety belt (shown as reference numeral 22 in FIG. 1). The means for securing the first end 16 is shown as a locking hook 30. The locking hook 30 is commonly referred to as a ladder hook or a snap hook. The locking hook 30 has a safety clasp 32 or other feature that helps prevent unintentional detachment from the support device. The means for securing the second end 20 is similarly shown as a locking hook 34 with a safety clasp 36. The means for securing the first end 16 and the second end 20 may additionally or alternatively include a single/double/triple pass buckle, an "S"-shaped hook, a gated/hinged/threaded carabiner, a bolt, and/or a pin.

The torso harness 10 includes the segment 24 of elastic cordage. The segment 24 of elastic cordage stretches to decelerate the technician during a fall from the utility pole (shown, respectively, as reference numerals 12 and 14 in FIG. 1). Although the segment 24 of elastic cordage may have any length, the preferred embodiment has a length not exceeding about three feet. This length allows the technician to maneuver at the utility pole and, yet, is not too long to entangle or encumber the technician. The segment 24 of elastic cordage should have a shock load rating of at least three times the technician's gross weight (e.g., body weight, clothing, tools, and other gear) and, preferably, at least five times the gross weight. The term "elastic" means the cordage absorbs energy and springs back to substantially its same length after being stretched. The elastic property of the cordage is popularly referred to as a "bungee cord," although many different construction techniques and processes can achieve the elastic property. The segment 24 of elastic cordage, for example, may have a rubber core with a braided, outer jacket. The segment 24 of elastic cordage may also have variously-oriented yarn fibers that stretch to produce the elastic property. The segment 24 of elastic cordage may also have an outer sheathing to reduce mechanical abrasion. The segment 24 of elastic cordage may also be constructed of high-temperature resistant material for fire retardness.

Figure 3:
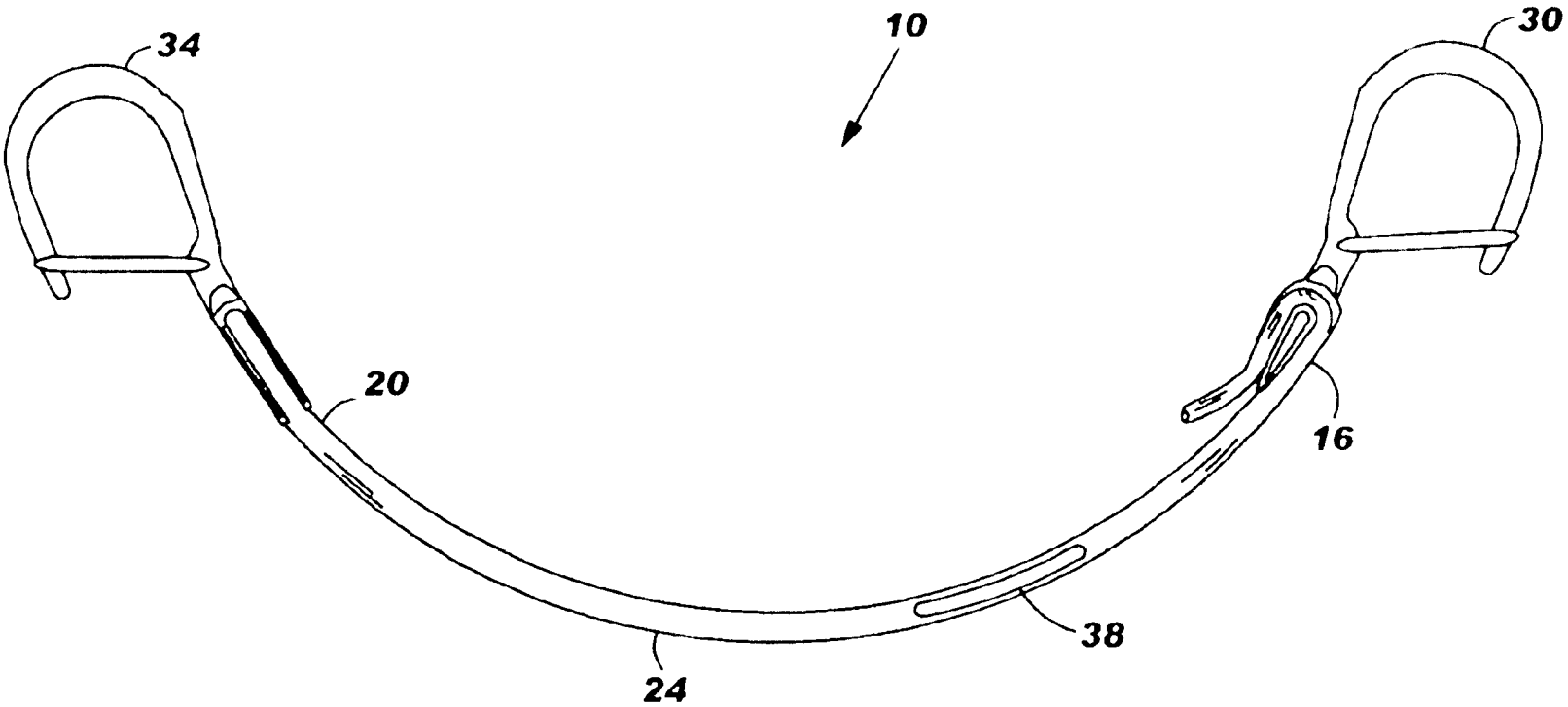
FIGS. 3–5 are schematics illustrating another of the embodiments of the torso harness including technician indicia.
Figure 4:
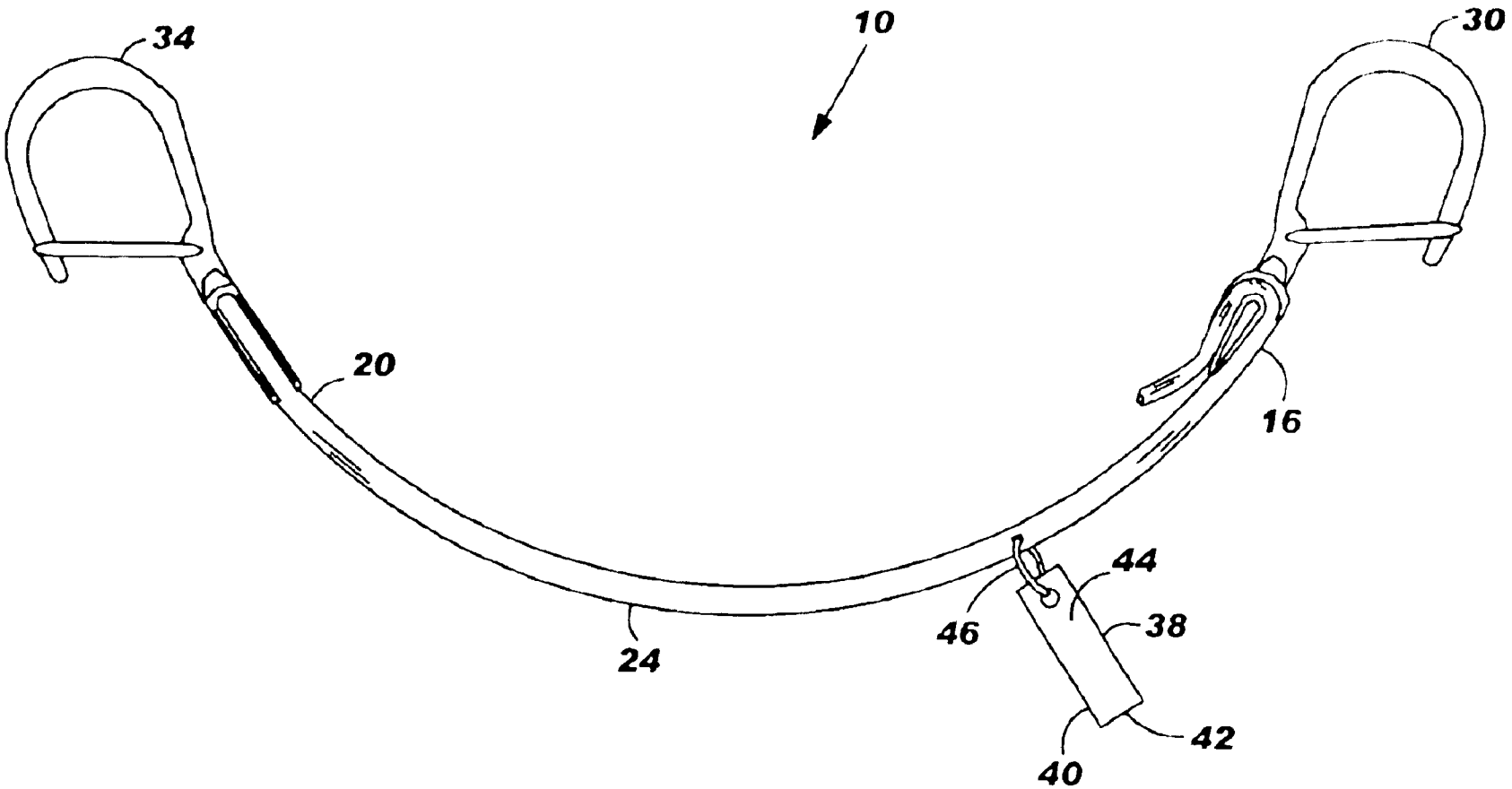
Figure 5:
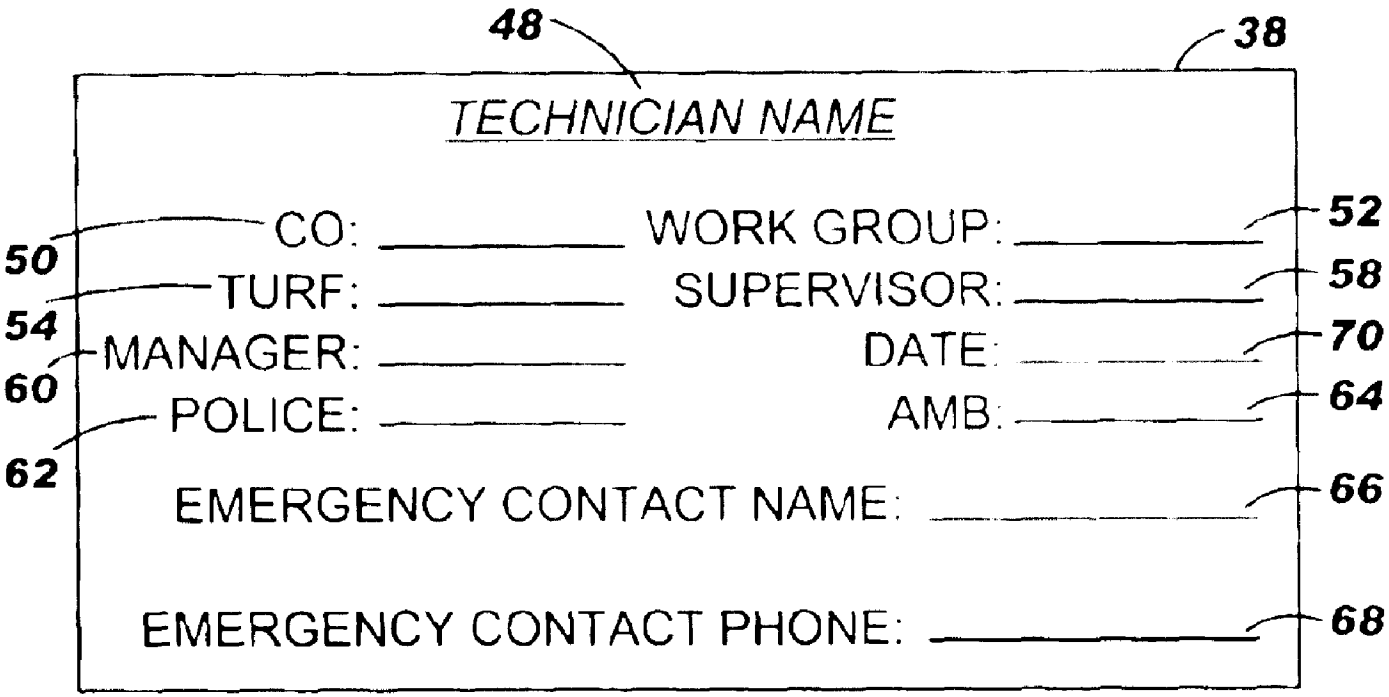

FIGS. 3–5 are schematics illustrating another of the embodiments of the torso harness 10 including technician indicia 38. FIG. 3 shows the technician indicia 38 presented on the segment 24 of elastic cordage, and the technician indicia is preferably marked or printed on the segment 24. FIG. 4 shows the technician indicia 38 presented as a tag 40 attached to any location along the torso harness 10. FIG. 5 is an enlarged, partial schematic illustrating the content of the technician indicia 38. The technician indicia 38 is associated with information related to the technician to whom the torso harness 10 is issued. The technician indicia 38 could also be associated with trackability information (e.g., name of a manufacturer, a model number, repair history, etc.). The technician indicia 38 may be alphanumeric characters, symbols, combinations thereof, and bar codes (e.g., "123 Palmer" Street). When the torso harness 10 includes the technician indicia 38, contrasting colors may be used to better distinguish the technician indicia 38 (e.g., black alphanumeric characters and/or symbols on a white surface). Further, the technician indicia 38 may be marked, printed, etched, affixed, attached, stamped, or adhered to the torso harness 10. Alternatively, other methods of marking the technician indicia 38 may be used, such as, for example, applying a film, substrate, magnetic material, or the like to the torso harness 10.

FIG. 4 shows the technician indicia 38 presented as a tag 40. The tag 40 has a tag body 42 and means for securing the tag 40 to the torso harness 10. The tag 40 has a surface 44 marked with the technician indicia 38. The technician indicia 38 comprise a preconceived pattern of information related to the technician to whom the torso harness 10 is issued. The tag 40 may be manufactured from a variety of materials, such as, for example, paper, cloth, metal, polymer, plastic, ceramic, glass, crystal, and other appropriate materials. Further, the tag 40 may be designed using a variety of shapes to suit the application. The tag 40 may include a separable, transparent sub-surface area located on the surface 44, the sub-surface area engaging the technician indicia 38 to locate the technician indicia 38 on the surface 44. Further, the tag 40 may be manufactured using any appropriate material that can withstand exposure to temperatures, humidity, ozone, and other environmental conditions.

The tag 40 secures to the torso harness 10. The tag 40 is preferably secured to the torso harness 10 using one or more ties 46. These ties 46 resemble common metal "bread ties" or plastic ties. The tag 40 could also secure to the torso harness 10 using adhesives, magnets, clips, screws, clamps, hooks, and any other mechanical and/or chemical securement.

FIG. 5 is a schematic illustrating the content of the technician indicia 38. The technician indicia 38 comprises various information related to the technician to whom the torso harness is issued (the torso harness is shown as reference numeral 10 in FIGS. 1–4). The technician indicia 38 could also be associated with trackability information, such as a name of a manufacturer of the torso harness, a model number of the torso harness, and/or any repair history. As FIG. 5 shows, the technician indicia 38 may include a name 48 of the technician, a central office ("C.O.") 50 to which the technician is assigned, and/or a work group 52 to which the technician is assigned. The technician indicia 38 may additionally or alternatively include a turf 54 to which the technician is assigned. The term "turf," as used herein, denotes a geographic area within a telecommunications network. The turf 54 could be a territory, a wire center, the boundary of one or more wire centers, or a portion of a wire center. The turf 54 could also be a composite of geographic areas, and the geographic areas may or may not be contiguous. The technician indicia 38 may additionally or alternatively include a supervisor's name 58 and/or a manager's name 60.

The technician indicia 38 may additionally or alternatively include emergency contact information. The technician indicia 38, for example, may include police 62 and ambulance 64 ("AMB") telephone numbers. The technician indicia 38 could also include a name 66 of an emergency contact person and/or an emergency contact number 68. Should the technician become injured, the technician indicia 38 would provide readily accessible information to contact emergency services, a family member or a friend, and the employer.

The technician indicia 38 may additionally or alternatively include a date 70. This date 70 could be date the torso harness was assigned, or was issued, to the technician. As the segment 24 of cordage ages, its elastic properties could change. The elastic properties could also change from exposure to environmental elements. As a safety precaution, then, the segment 24 of elastic cordage might be retired after a predefined time in the field. The date 70 helps the technician and/or other person monitor the age of the segment 24 of cordage.

Figure 6:
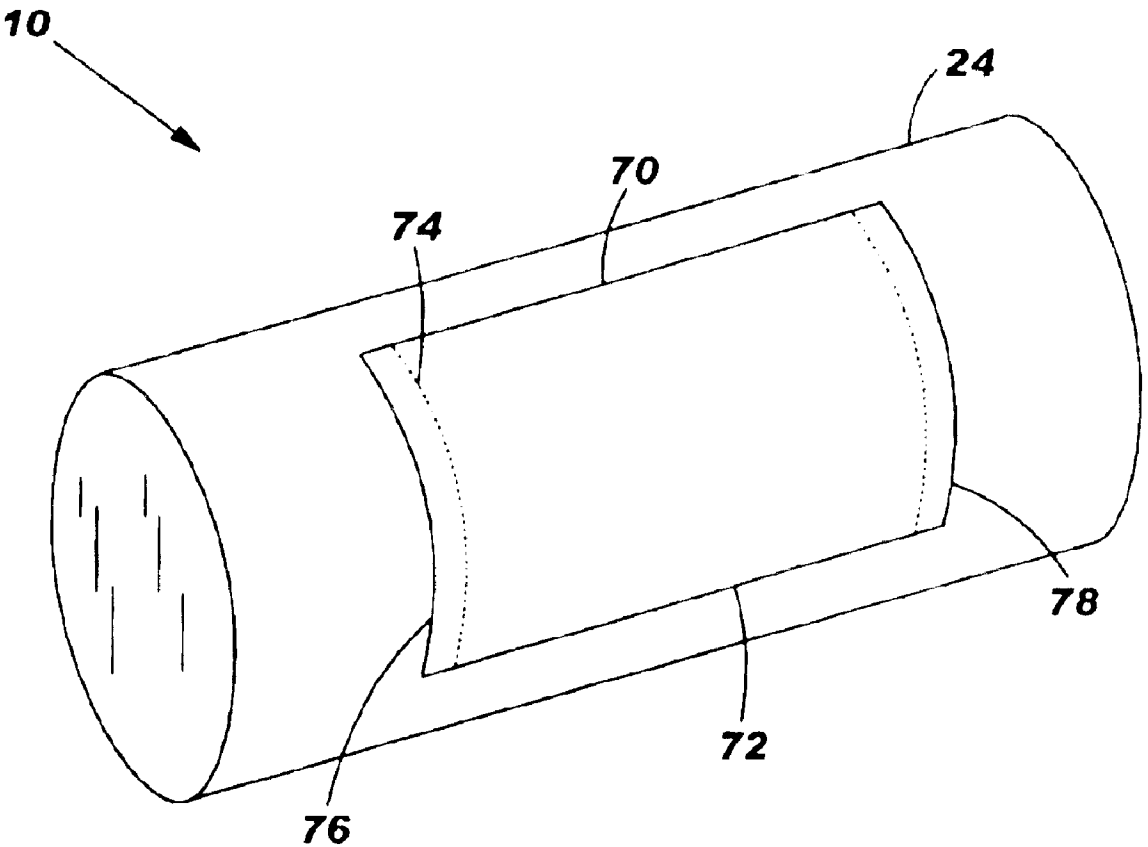
FIGS. 6 and 7 are schematics illustrating yet another of the embodiments of the torso harness including an indicator for alerting a technician that the torso harness has been stretched beyond a predefined length.
Figure 7:
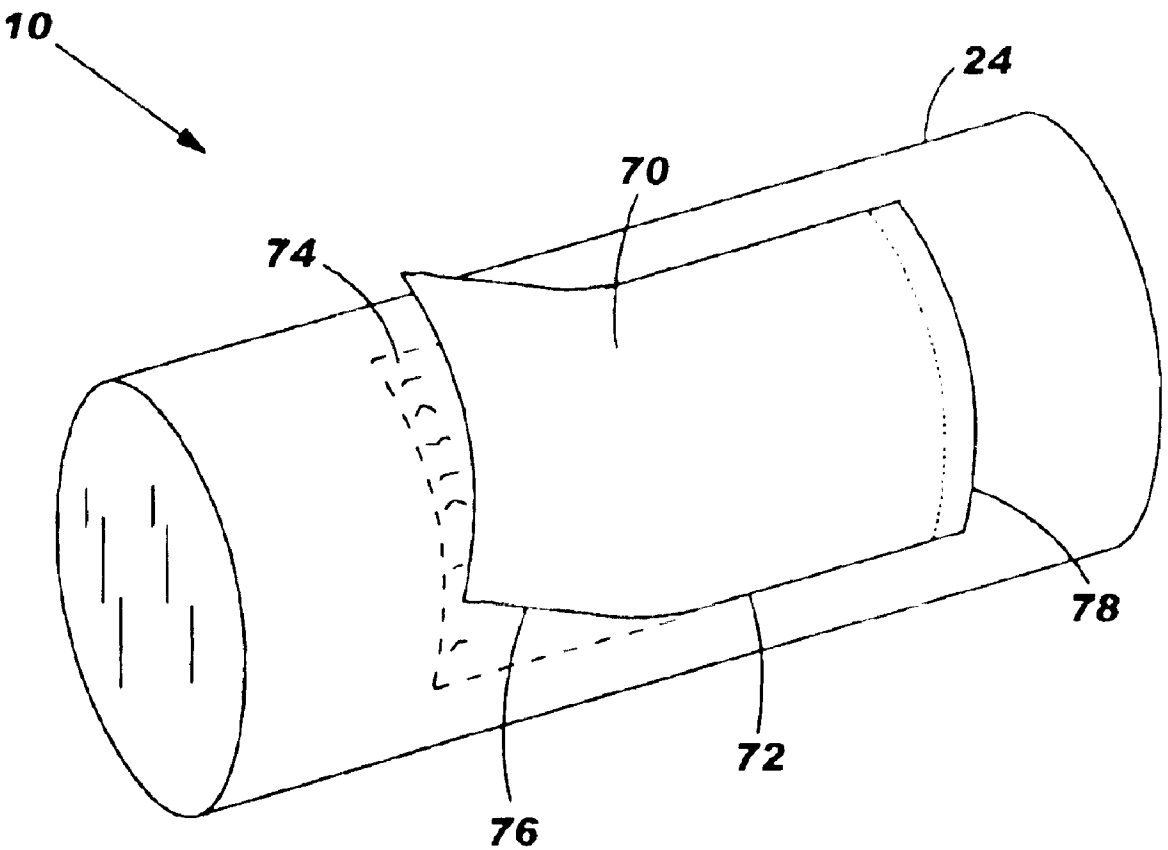

FIGS. 6 and 7 are schematics illustrating another of the embodiments of the torso harness 10. FIGS. 6 and 7 are partial views of the segment 24 of elastic cordage, and FIGS. 6 and 7 show an indicator 70. This indicator 70 preferably attaches to the segment 24 of elastic cordage and, yet, tears when the segment 24 of elastic cordage is stretched. The indicator 70 could then alert the technician or other person that the segment 24 of elastic cordage has been stretched beyond a predefined length. Because the segment 24 of elastic cordage cannot have perfect, ideal elasticity, its elastic properties could change when stretched beyond a certain point, such as when the technician falls from the utility pole (shown as reference numeral 24 in FIG. 1). As another safety precaution, then, the segment 24 of elastic cordage might be retired when the indicator 70 tears.

The indicator 70 could have various configurations. As FIG. 6 shows, the indicator 70 could be a relatively inelastic label 72 that is sown to the segment 24 of elastic cordage. When the segment 24 of elastic cordage stretches, the label 72 does not have the same elastic, stretching properties. As FIG. 7 shows, then, threads 74 at one end 76 of the label 72 tear from the segment 24. An opposite end 78 of the label 72, however, remains sown to the segment 24 of cordage. The torn end 76 of the label 72 would then indicate the segment 24 of elastic cordage was stretched beyond a certain point, so the segment 24 of elastic cordage might be retired. Although the label 72 is shown as discussed as being sown to the segment 24 of elastic cordage, the label 72 could also be stapled, bonded, and/or adhered.

Figure 8:
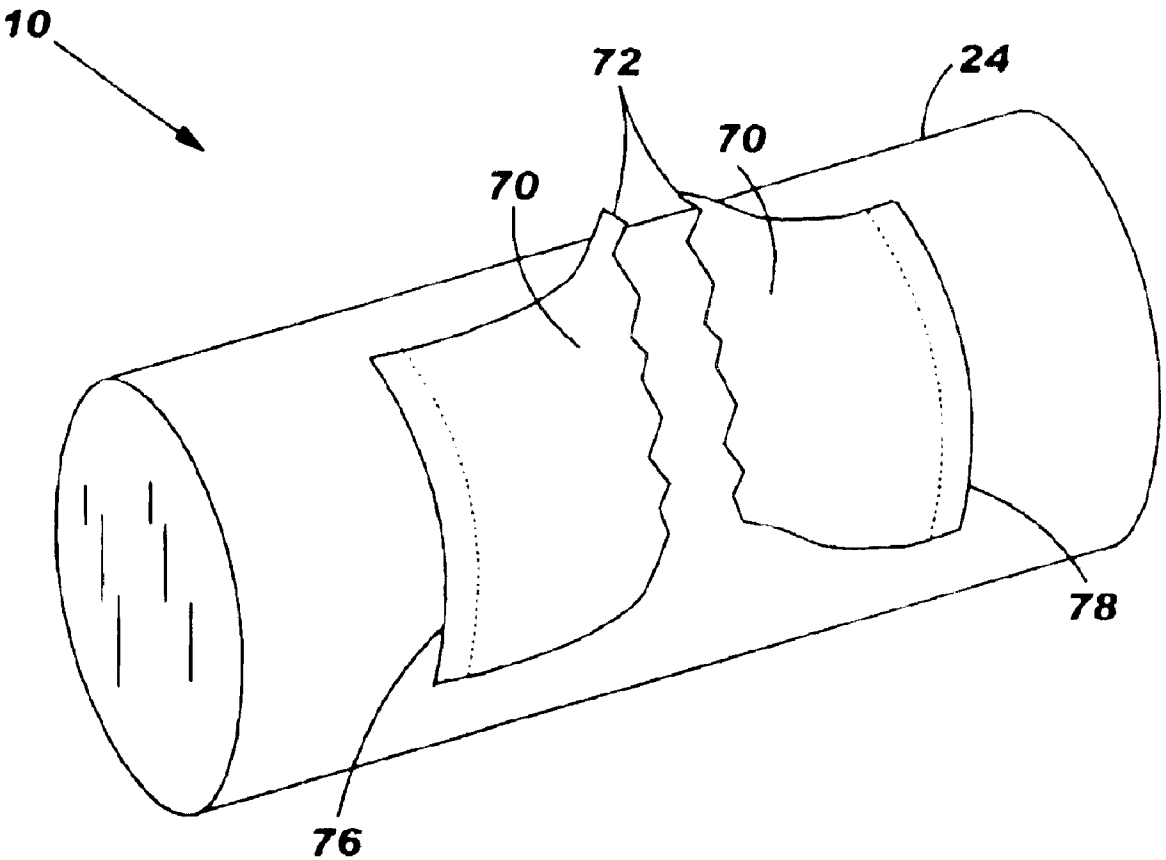
FIGS. 8 and 9 are schematics illustrating other embodiments of the indicator shown in FIGS. 6 and 7.

FIG. 8 is a schematic illustrating another embodiment of the torso harness 10. FIG. 8 is again a partial view of the segment 24 of elastic cordage showing the indicator 70. Here the indicator 70 itself tears when the segment 24 of elastic cordage is stretched. Each end 76 and 78 of the label 72 is affixed to the segment 24 of elastic cordage. When the segment 24 of elastic cordage stretches, the relatively inelastic label 72 does not stretch and, instead, tears. The torn label 72 would then indicate the segment 24 of elastic cordage was stretched and might be retired.

Figure 9:
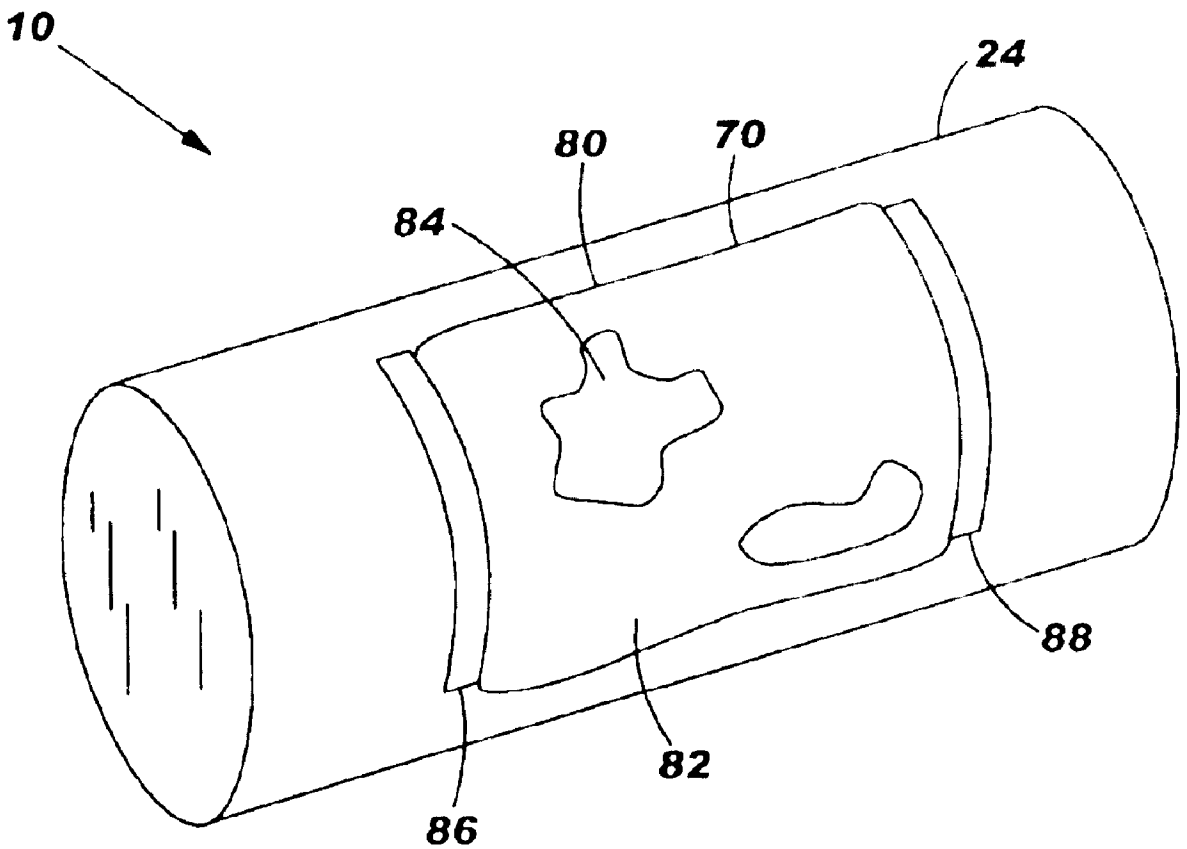

FIG. 9 is a schematic illustrating another of the embodiments of the torso harness 10. FIG. 9 is again a partial view of the segment 24 of elastic cordage showing the indicator 70. Here the indicator 70 includes a dye pack 80. The dye pack 80 is a plastic/polymer package 82 containing a dye 84. Opposite ends 86 and 88 of the package 82 are affixed to the segment 24 of elastic cordage. When the segment 24 of elastic cordage is stretched, the package 82 tears and releases the dye 84. The dye 84 could be a colored liquid or powder that stains the segment 24 of cordage. The stain would then indicate the segment 24 of elastic cordage was stretched and might be retired.

Figure 10:
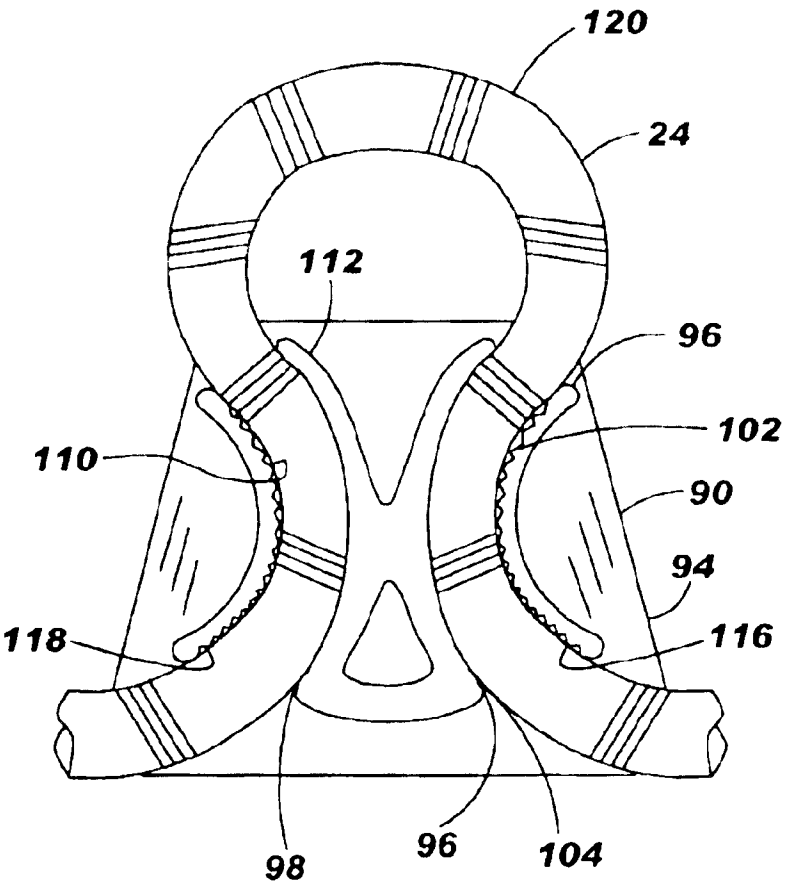
FIGS. 10 and 11 are schematics showing another of the embodiments of the torso harness including a length adjuster.
Figure 11:
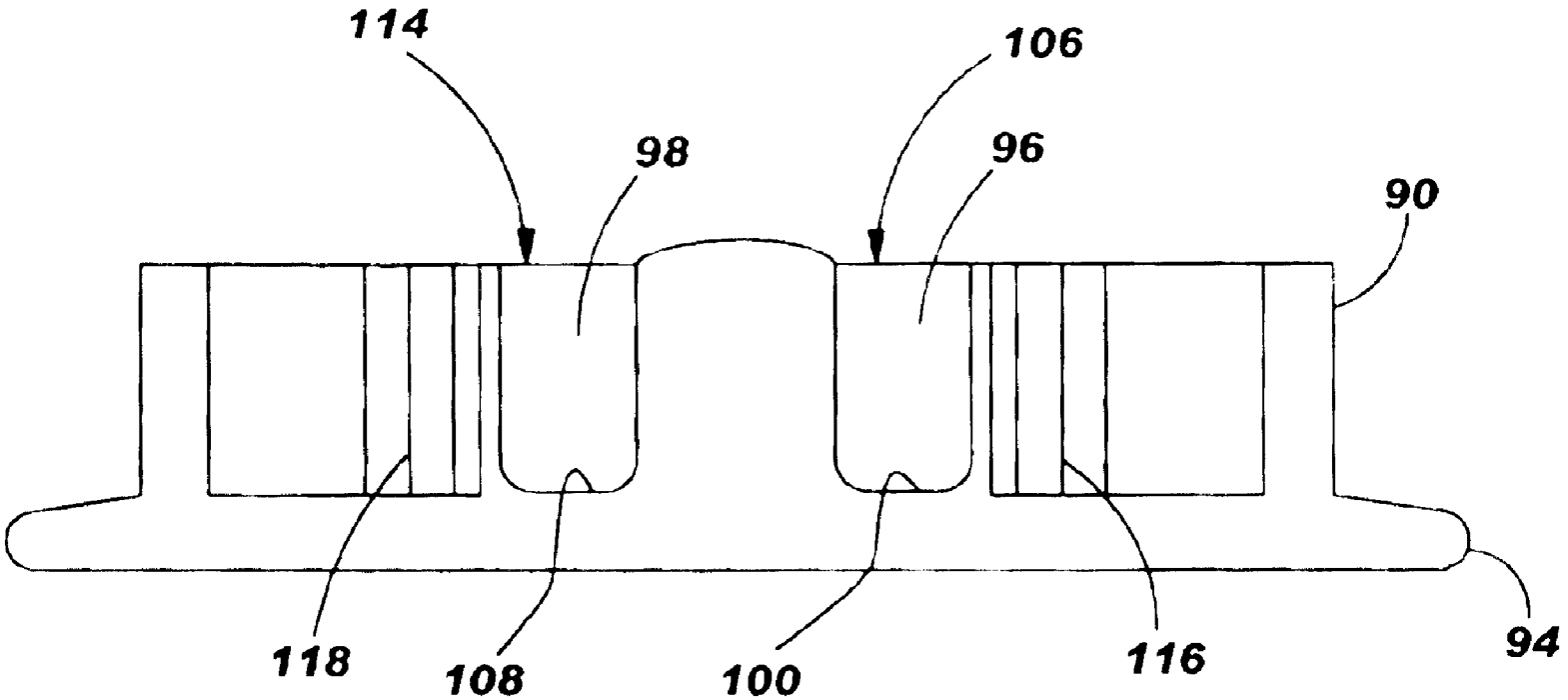

FIGS. 10 and 11 are schematics illustrating still another of the embodiments of the torso harness. FIG. 10 is again a partial view of the segment 24 of elastic cordage. Here, however, a length adjuster 90 allows the segment 24 of elastic cordage to be lengthened and shortened. FIG. 11 is a side orthographic view of the length adjuster 90. The length adjuster 90 lengthens and shortens an effective length of the torso harness (shown as reference numeral 10 in FIGS. 1 and 2). The length adjuster 90 has a body 94, a first channel 96, and a second channel 98. The first channel 96 has a bottom surface 100, an inside arcuately-shaped side surface 102, and an outside arcuately-shaped side surface 104. The side surfaces 102 and 104 upwardly extend from the bottom surface 100, and the first channel 96 has an open top 106. The second channel 98, likewise, has a bottom surface 108, an upwardly extending inside arcuately-shaped side surface 110, an upwardly extending outside arcuately-shaped side surface 112, and an open top 114. The first channel 96 has a serrated inner surface 116, and the second channel 98 may also have a serrated inner surface 118. The segment 24 of elastic cordage inserts into the first channel 96, forms a loop 120, and then inserts into the second channel 98. The size/length of the loop 120 allows the technician to lengthen or to shorten the effective length $L_{ef}$ of the torso harness. Because the first channel 96 and the second channel 98 each have the respective serrated inner surfaces 116 and 118, the channels 96 and 98 frictionally grip the segment 24 of elastic cordage and prevent slippage along the channels 96, 98. The length adjuster 90 thus allows the segment 24 of elastic cordage to be lengthened and shortened to accommodate the technician's arm reach and leg length. The segment 24 of elastic cordage may also be lengthened and shortened to accommodate the height of the job on the utility pole, the technician's weight, and the technician's height. The height the technician ascends the utility pole, the technician's weight, and the technician's height may influence the energy absorption of the segment 24 of elastic cordage.

Figure 12:
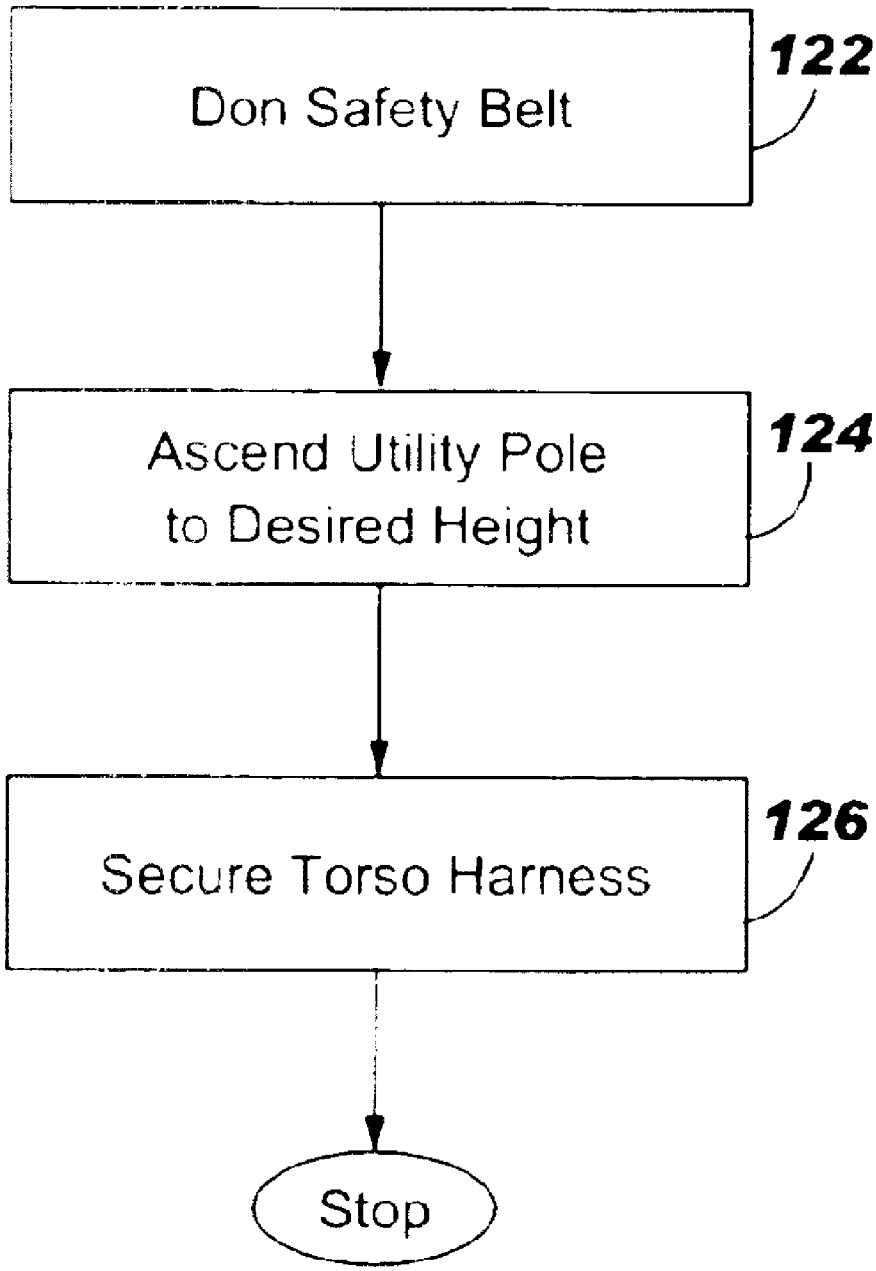
FIG. 12 is a flowchart showing a method for reducing injury from a fall from a utility pole.

FIG. 12 is a flowchart illustrating a method for reducing injury from a fall from a utility pole. A technician dons a safety belt (Block 122) and ascends a utility pole to a desired height (Block 124). A torso harness is secured (Block 126) between the technician's safety belt and a support device in the utility pole. The torso harness includes a segment of elastic cordage having a first end and a second end, means for securing the first end to the support device in the utility pole, and means for securing the second end to the technician's safety belt. The torso harness stretches to decelerate the technician during a fall from the utility pole.

While the present invention has been described with respect to various features, aspects, and embodiments, those skilled and unskilled in the art will recognize the invention is not so limited. Other variations, modifications, and alternative embodiments may be made without departing from the spirit and scope of the present invention.

What is claimed is:

1. A torso harness, comprising:

a segment of elastic cordage having a first end and a second end;

means for securing the first end to a support device in a utility pole;

means for securing the second end to a technician's safety belt; and an indicator attached to the segment of elastic cordage, the indicator tearing when the segment of elastic cordage stretches during a fall from the utility pole, the indicator including a dye that stains the torso harness.

wherein the segment of elastic cordage stretches to decelerate the technician during the fall from the utility pole.

2. A torso harness according to claim 1, further comprising a technician indicia attached to the torso harness, the technician indicia associated with information related to the technician to whom the torso harness is issued.

3. A torso harness according to claim 2, wherein the technician indicia comprises a name of the technician.

4. A torso harness according to claim 2, wherein the technician indicia comprises the name of a central office to which the technician is assigned.

5. A torso harness according to claim 2, wherein the technician indicia comprises the name of a work group to which the technician is assigned.

6. A torso harness according to claim 2, wherein the technician indicia comprises the name of a turf to which the technician is assigned.

7. A torso harness according to claim 2, wherein the technician indicia comprises the name of a work group to which the technician is assigned.

8. A torso harness according to claim 2, wherein the technician indicia comprises a date the torso harness was assigned to the technician.

9. A torso harness according to claim 1, wherein the segment of elastic cordage has a length not exceeding about three feet.

10. A torso harness according to claim 1, further comprising a length adjuster that lengthens and shortens the segment of elastic cordage.

11. A torso harness according to claim 10, wherein the length adjuster comprises a body having at least one channel, the segment of elastic cordage inserting into the at least one channel and creating a loop that can lengthen or shorten the segment of elastic cordage.

12. A torso harness according to claim 11, wherein the at least one channel has a serrated surface to grip the segment of elastic cordage.

13. A torso harness according to claim 1, further comprising:

a length adjuster that lengthens and shortens an effective length of the torso harness, the length adjuster comprising a body having a first channel and a second channel, the first channel and the second channel each having a bottom surface with arcuately-shaped side surfaces upwardly extending from the bottom surface, the first channel and the second channel each having an open top for insertion of the segment of elastic cordage, the first channel and the second channel each having a serrated inner surface to grip the segment of elastic cordage, wherein the segment of elastic cordage inserts into the first channel, forms a loop, and then inserts into the second channel, thus allowing the loop to lengthen or to shorten the effective length of the torso harness.

14. A method of attaching a safety harness to a pole, comprising:

donning a technician's safety belt;

ascending a utility pole to a desired height;

securing a torso harness between the technician's safety belt and a support device in the utility pole, the torso harness comprising a segment of elastic cordage having a first end and a second end, means for securing the first end to the support device in the utility pole, means for securing the second end to the technician's safety belt, and an indicator attached to the segment of elastic cordage, the indicator tearing when the segment of elastic cordage stretches during a fall from the utility pole, the indicator including a dye that stains the torso harness.

wherein the torso harness stretches to decelerate the technician during a fall from the utility pole.

* * * * *

UNITED STATES PATENT AND TRADEMARK OFFICE

CERTIFICATE OF CORRECTION

PATENT NO. : 6,959,784 B2
APPLICATION NO. : 10/643178
DATED : November 1, 2005
INVENTOR(S) : Fred Diggle and Knox Faulkner It is certified that error appears in the above-identified patent and that said Letters Patent is hereby corrected as shown below:

Item (73)
The assignee should be listed as:

BellSouth Intellectual Property Corporation
824 Market Street
Wilmington, Delaware 19801 --

Signed and Sealed this

Eighth Day of August, 2006

JON W. DUDAS
*Director of the United States Patent and Trademark Office*